United States Patent [19]

Edwards

[11] 4,088,426

[45] May 9, 1978

[54] SLIDING VANE TYPE OF COMPRESSOR-EXPANDER HAVING DIFFERENTIAL ECCENTRICITY FEATURE

[75] Inventor: Thomas C. Edwards, Oviedo, Fla.

[73] Assignee: The Rovac Corporation, Rockledge, Fla.

[21] Appl. No.: 686,829

[22] Filed: May 17, 1976

[51] Int. Cl.[2] ..... F25D 9/00; F01C 13/00; F01C 21/00; F01C 11/00

[52] U.S. Cl. ..... 418/8; 418/13; 418/15; 418/83; 418/100; 418/101; 418/152; 418/178; 418/260; 418/264; 62/402

[58] Field of Search ..... 418/8, 13, 15, 83, 100, 418/101, 152, 153, 178, 181, 260, 264; 62/87, 402

[56] References Cited

U.S. PATENT DOCUMENTS

| | | | |
|---|---|---|---|
| 711,168 | 10/1902 | Lawrence | 418/13 |
| 920,976 | 5/1909 | Minor | 418/264 |
| 2,470,655 | 5/1949 | Shaw | 418/100 |
| 2,498,029 | 2/1950 | Clerc | 418/264 |
| 2,672,282 | 3/1954 | Novas | 418/152 |
| 2,818,024 | 12/1957 | Herschel | 418/152 |
| 2,826,151 | 3/1958 | McCray | 418/153 |
| 2,868,442 | 1/1959 | Nilsson | 418/152 |
| 3,016,184 | 1/1962 | Hart | 418/101 |
| 3,191,852 | 6/1965 | Kaatz et al. | 418/152 |
| 3,369,399 | 2/1968 | Coffman et al. | 418/152 |
| 3,601,513 | 8/1971 | White, Jr. | 418/179 |
| 3,686,893 | 8/1972 | Edwards | 62/402 |
| 3,949,711 | 4/1976 | Shobert | 418/152 |

FOREIGN PATENT DOCUMENTS

| | | | |
|---|---|---|---|
| 24,366 | 1/1931 | Australia | 418/264 |
| 2,254,185 | 5/1974 | Germany | 418/15 |
| 434,660 | 4/1948 | Italy | 418/260 |
| 656,601 | 12/1960 | United Kingdom | 418/15 |

*Primary Examiner*—John J. Vrablik

*Attorney, Agent, or Firm*—Leydig, Voit, Osann, Mayer & Holt, Ltd.

[57] ABSTRACT

A compressor-expander for use in air conditioning including a chamber of generally elliptical cross section having a compressor side and an expander side each with inlet and outlet ports. Rotatable in the chamber is a vaned rotor defining enclosed compartments in which the air is positively compressed accompanied by an increase in temperature in the compressor side and is positively expanded with a decrease in temperature in the expander side, the elliptical eccentricity of the compressor side being less than 0.62 and the eccentricity on the expander side being less than the eccentricity of the compressor side in a ratio lying between 0.68 and 0.95. Pressure in the compartment at the point of discharge is substantially at atmosphere level, and the expander outlet port is so located that when a compartment on the expander side is centered on the major axis, the leading vane is at the threshold of discharge. Dissipation openings of progressively increasing size are provided at the threshold for throttling the discharge in the event that the pressure in the discharging compartment varies slightly from the atmospheric level. The compressor side outlet port and the expander side inlet port are curvingly divergent and convergent, respectively, providing a smooth transition between tangential and radial movement of the pressurized air. The end bells enclosing the elliptical chamber each have an integral outer wall of elliptical shape bounded by a flat end face as well as an integral inner wall formed by a bearing sleeve, the walls, between them, defining a roller space for accommodating, in overlapping relation, guide rollers on the respective vanes. The vanes are of special construction, being formed of wear-resistant non-metallic material with a thin metal insert terminating at its ends in alined stub shafts for the rollers. The rotor and vanes are preferably formed of carbon, and the stator is preferably formed of carbon or magnesium.

11 Claims, 25 Drawing Figures

SLIDING VANE TYPE OF COMPRESSOR-EXPANDER HAVING DIFFERENTIAL ECCENTRICITY FEATURE

Compressor-expanders used for refrigeration purposes, employing air in a reverse Brayton cycle, as set forth in my prior U.S. Pat. No. 3,686,893 of Aug. 29, 1972, can offer a high coefficient of performance and a high degree of simplicity and economy as compared to compressor type refrigerators employing a separate refrigerating medium such as freon. However, compressor-expanders have presented problems of friction and thermal expansion which tend to affect performance and operating life in addition to generation of noise in a degree which varies with ambient conditions.

By making relatively simple, yet sophisticated, changes in design it has been found possible to overcome these problems.

It is, therefore, an object of the present invention to provide a compressor-expander which is highly efficient and which has a long useful life, free of the problems of friction and thermal expansion. It is a related object to provide a compressor-expander which is, in addition to the above, of highly simplified construction, employing a minimum number of parts which may be economically produced and assembled to form a unit which is highly compact and which requires a minimum of maintenance.

It is a feature of the invention in one of its aspects to provide a compressor-expander having limited elliptical eccentricity and in which the eccentricity on the expander side is less than the eccentricity on the compressor side within a predetermined range or ratio, resulting in a number of novel benefits.

It is a more detailed object to provide a compressor-expander in which the ports handling the air in compressed state, and the vane tips as well, are specially shaped to minimize energy losses due to throttling.

It is an object of the invention in one of its aspects to provide a compressor-expander having the above benefits in which the rotor, vanes, and even the frame, are fabricated of densified amorphous carbon to minimize frictional drag and the effects of thermal expansion while reducing mass and inertia.

It is a general object to provide a compressor-expander which is ideally suited for universal usage in refrigeration heat pump and air conditioning systems, both fixed and automotive, wherever cooling or heating on an economical basis is required.

Other objects and advantages of the invention will become apparent upon reading the attached detailed description and upon reference to the drawings in which.

Figure 3:
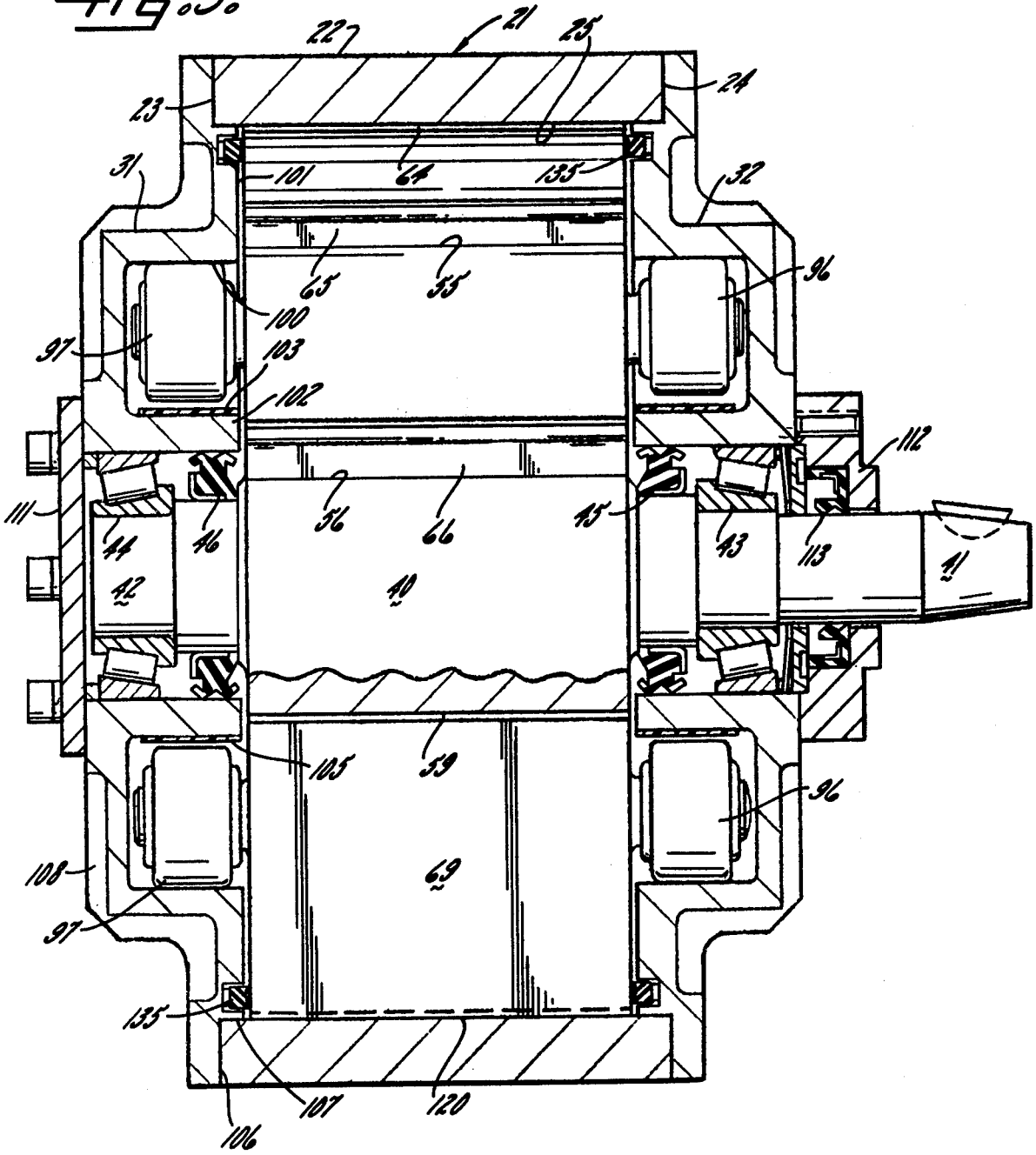
FIG. 3 is a vertical section taken along the line 3—3 in FIG. 1, vane clearances being greatly exaggerated.
Figure 3A:
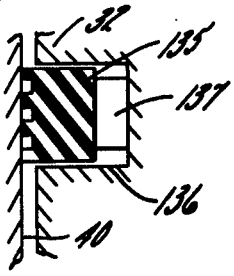

FIG. 3*a* shows a cross section of rotor seal of FIG. 3.

Figure 3B:
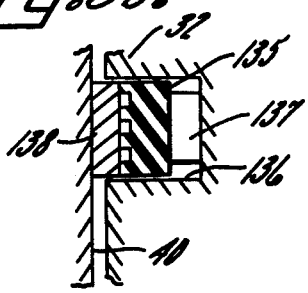

FIG. 3*b* shows, in cross section, an alternate form of seal.

Figures 1, 4:
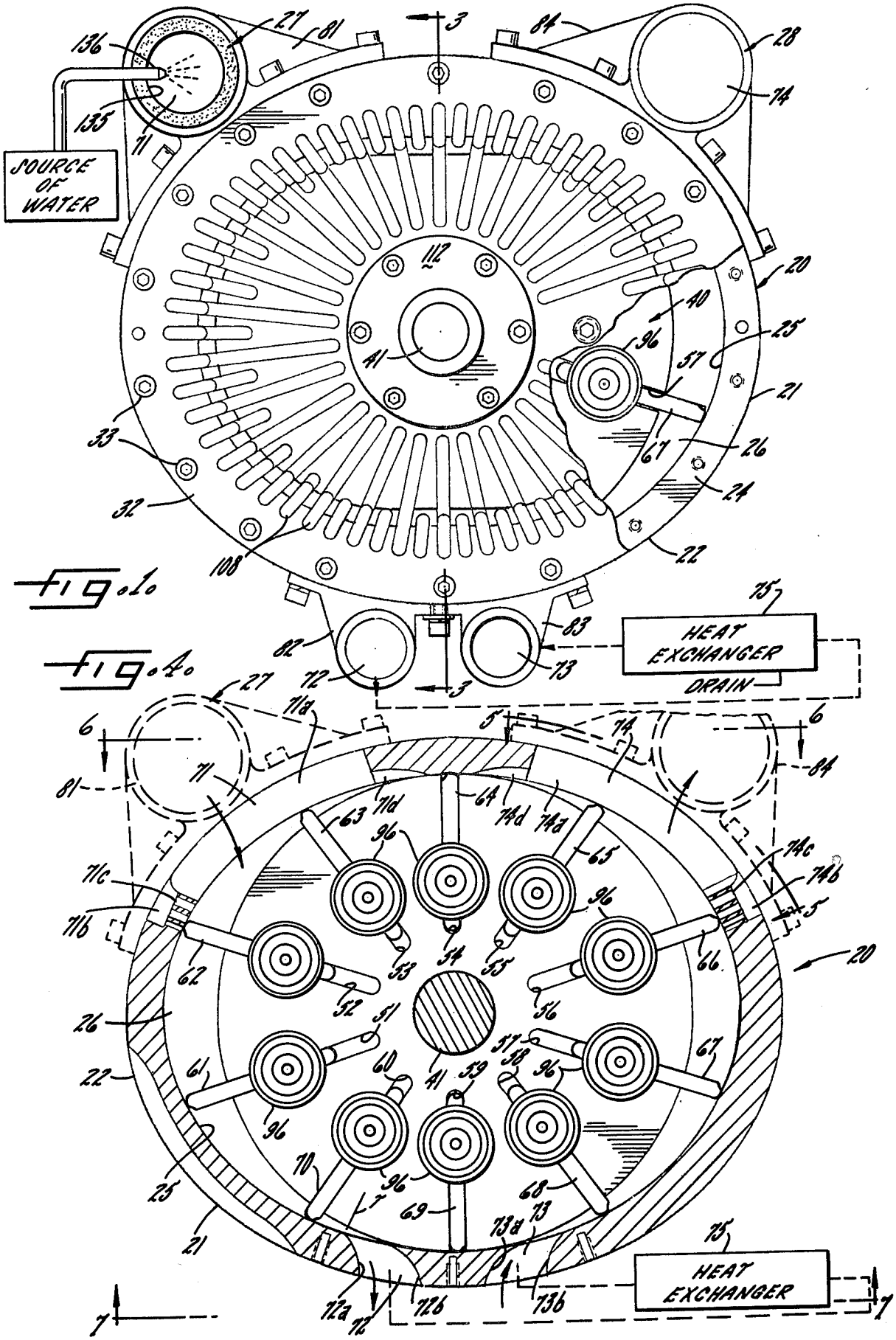
FIG. 1 is an end elevational view of a compressor-expander constructed in accordance with the invention with a portion of the end bell broken away.
Figure 2:
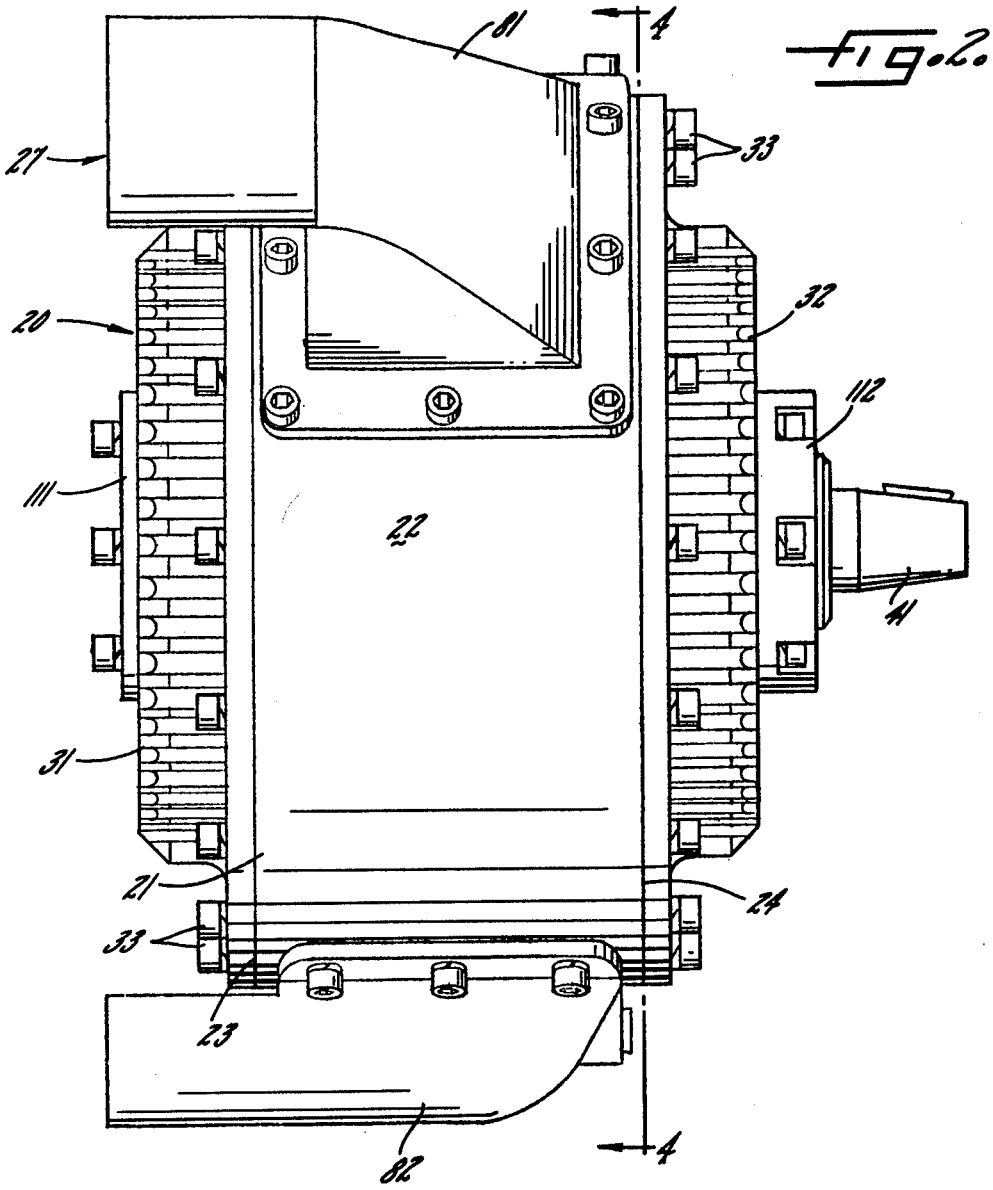
FIG. 2 is a side elevational view of the device shown in FIG. 1.

FIG. 4 is a cross section taken along line 4—4 in FIG. 2 with the manifolds, however, shown in phantom.

Figure 5:
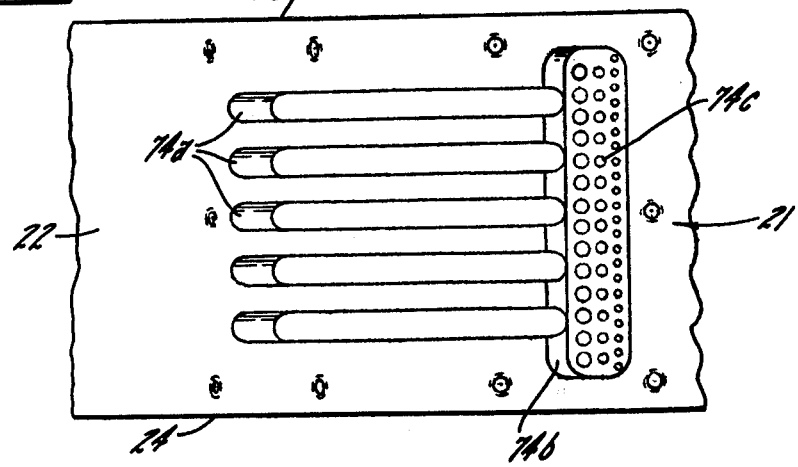

FIG. 5 is a fragmentary view looking along the line 5—5 in FIG. 4.

Figure 6:
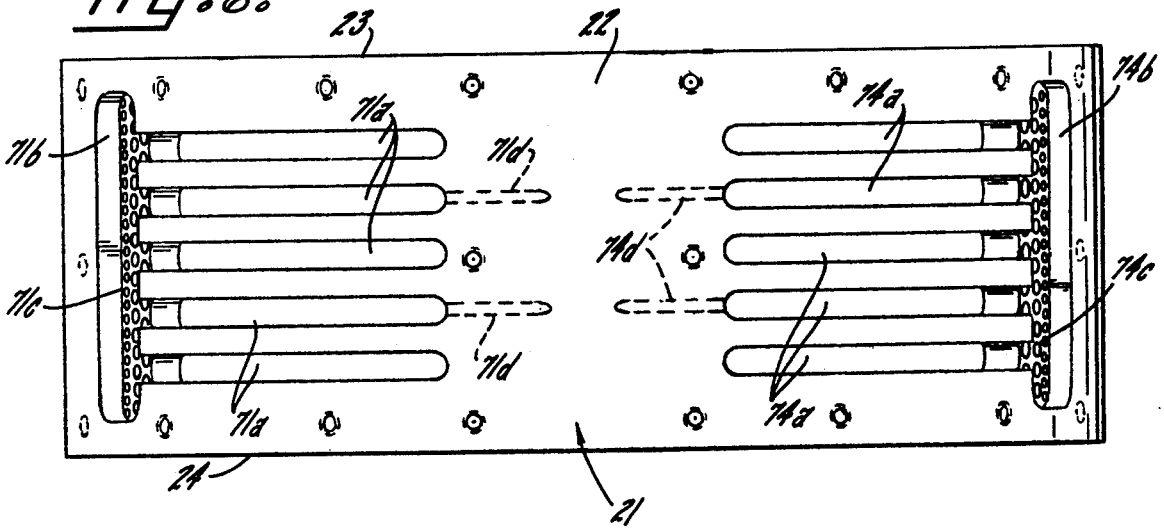

FIG. 6 is a top view of the porting looking along the line 6—6 in FIG. 4.

Figure 7:
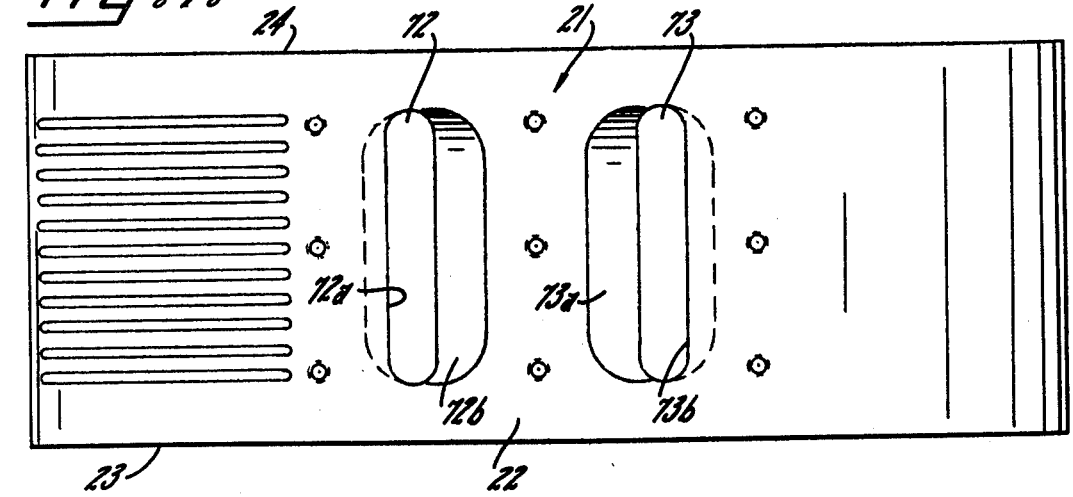

FIG. 7 is a bottom view of the porting looking along lines 7—7 in FIG. 4.

Figure 8:
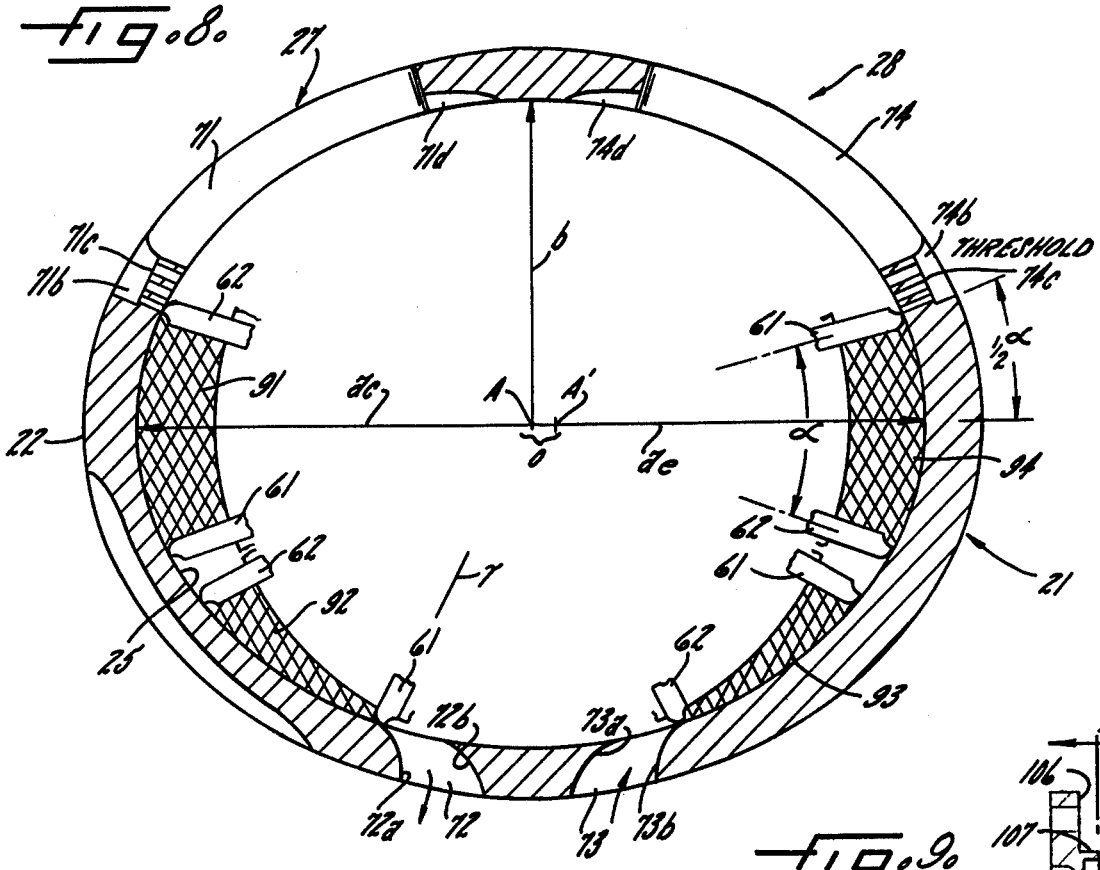

FIG. 8 is a diagram similar to FIG. 4 but showing the volumes of the compartments at significant points in the rotative cycle.

Figure 8A:
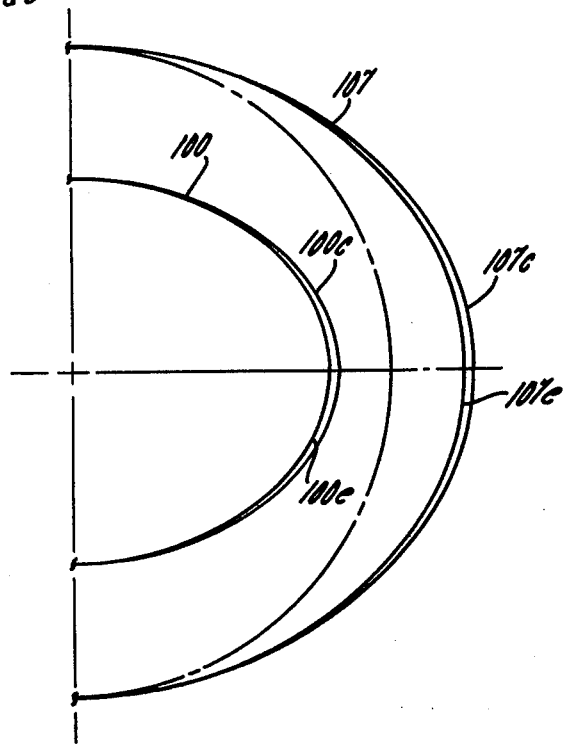

FIG. 8*a* is a diagram comparing the eccentricity of the expander and compressor sides.

Figure 9:
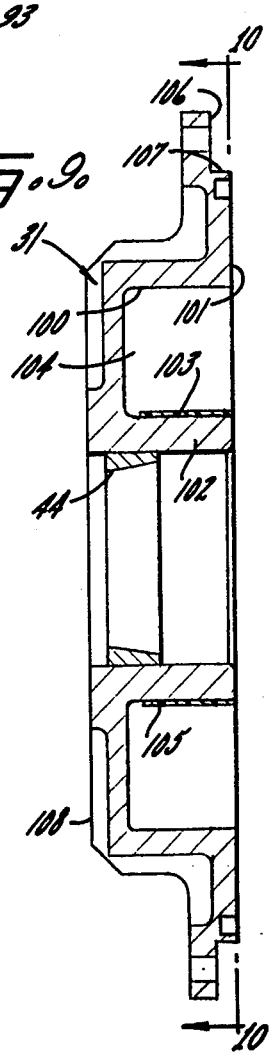

FIG. 9 shows a cross section of a typical end bell.

Figure 10:
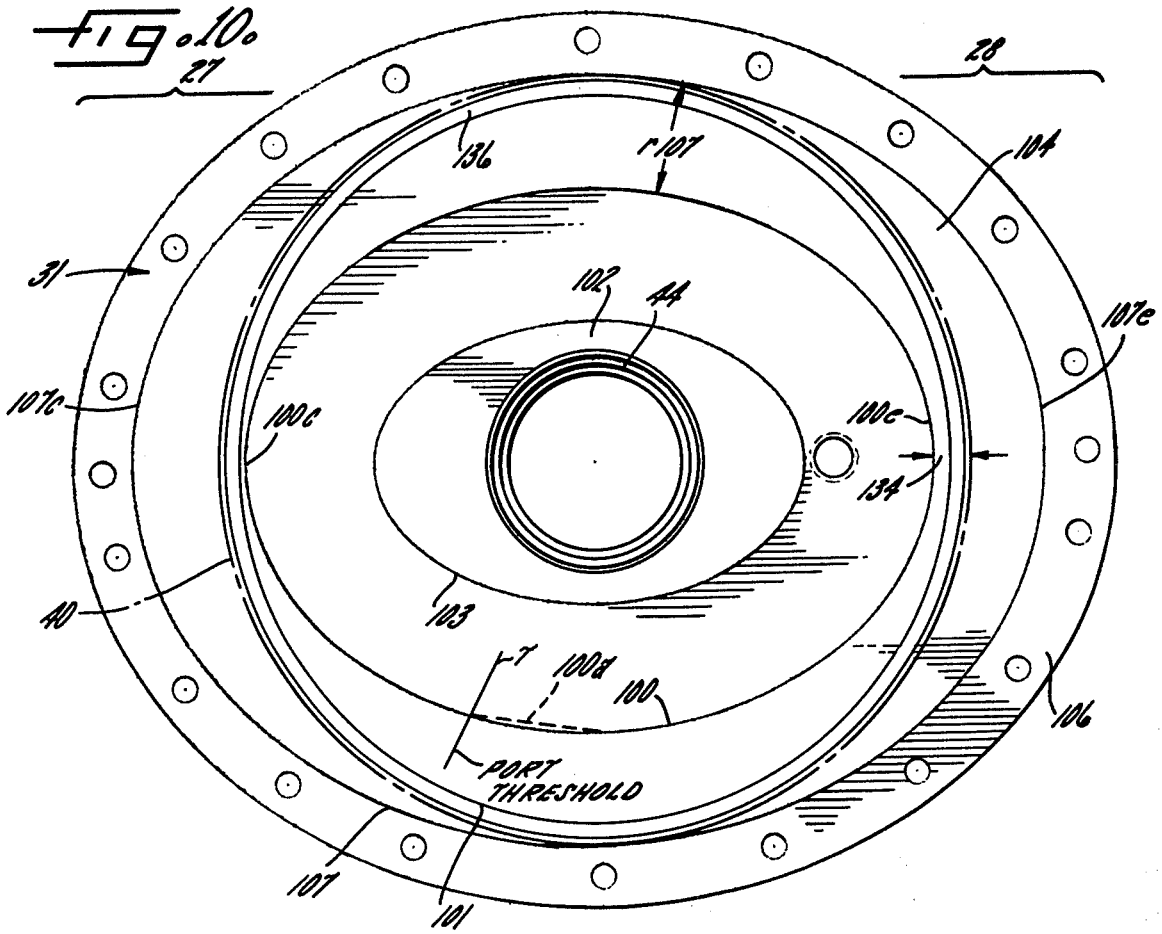

FIG. 10 is a face view of the end bell of FIG. 9.

Figure 11:
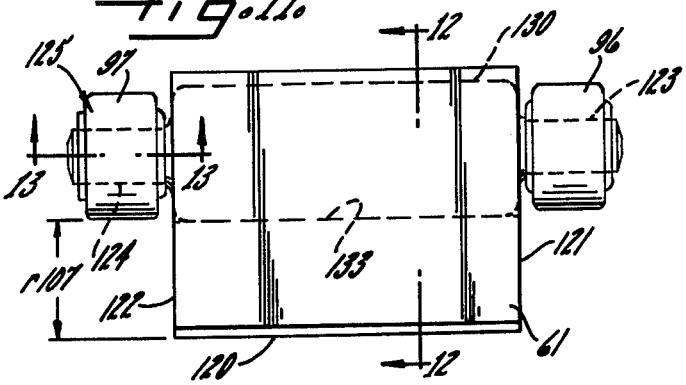

FIG. 11 shows the profile of a typical vane.

Figure 12:
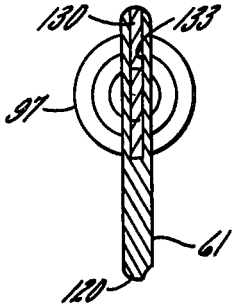

FIG. 12 is a cross section taken along line 12—12 in FIG. 11.

Figure 12A:
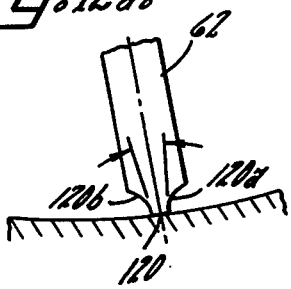

FIG. 12*a* shows the effect of chamfering the leading edge of a vane tip.

Figure 13:
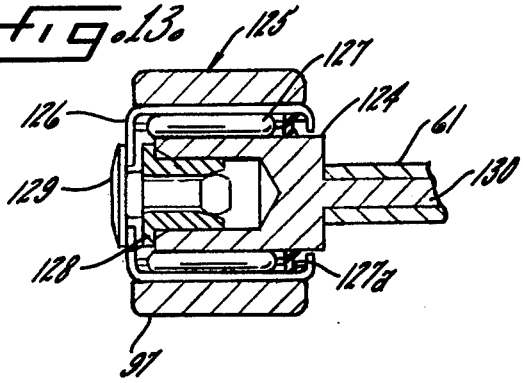

FIG. 13 shows a cross-section taken through a guide roller looking along line 13—13 in FIG. 11.

Figure 14:
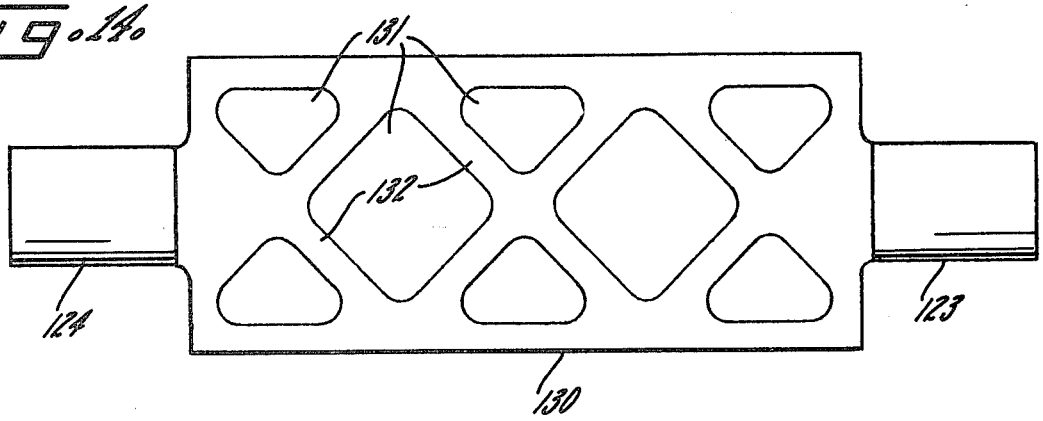

FIG. 14 is a profile view of a vane insert.

Figure 15:
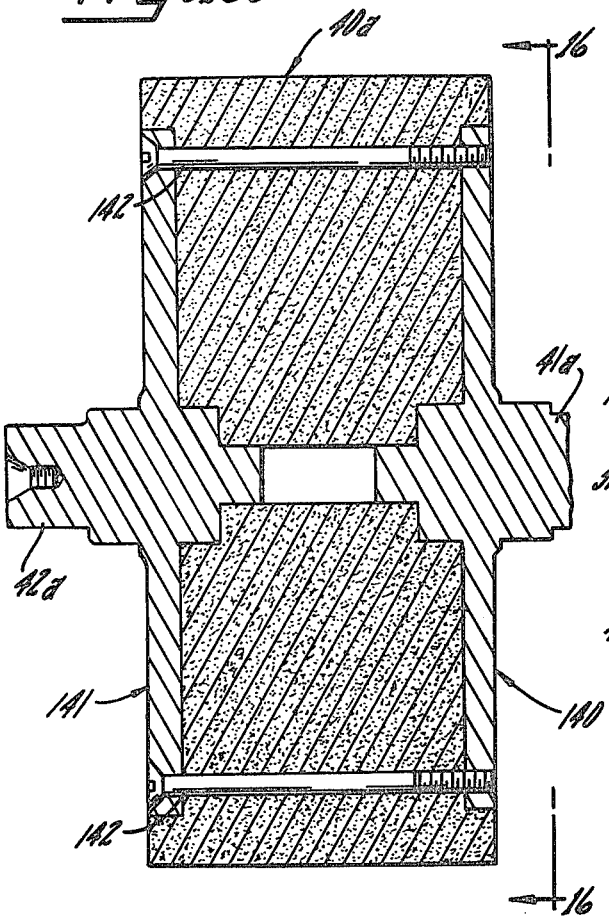
Figure 16:
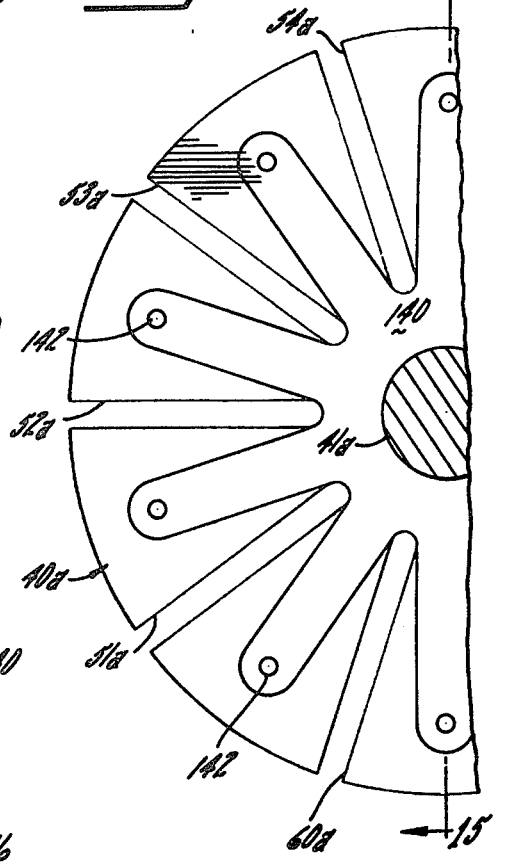

FIG. 15 is a cross sectional view of a reinforced rotor formed of amorphous carbon and looking along line 15—15 in FIG. 16.

FIG. 16 is an end view of the rotor looking along line 16—16 in FIG. 15.

Figure 17:
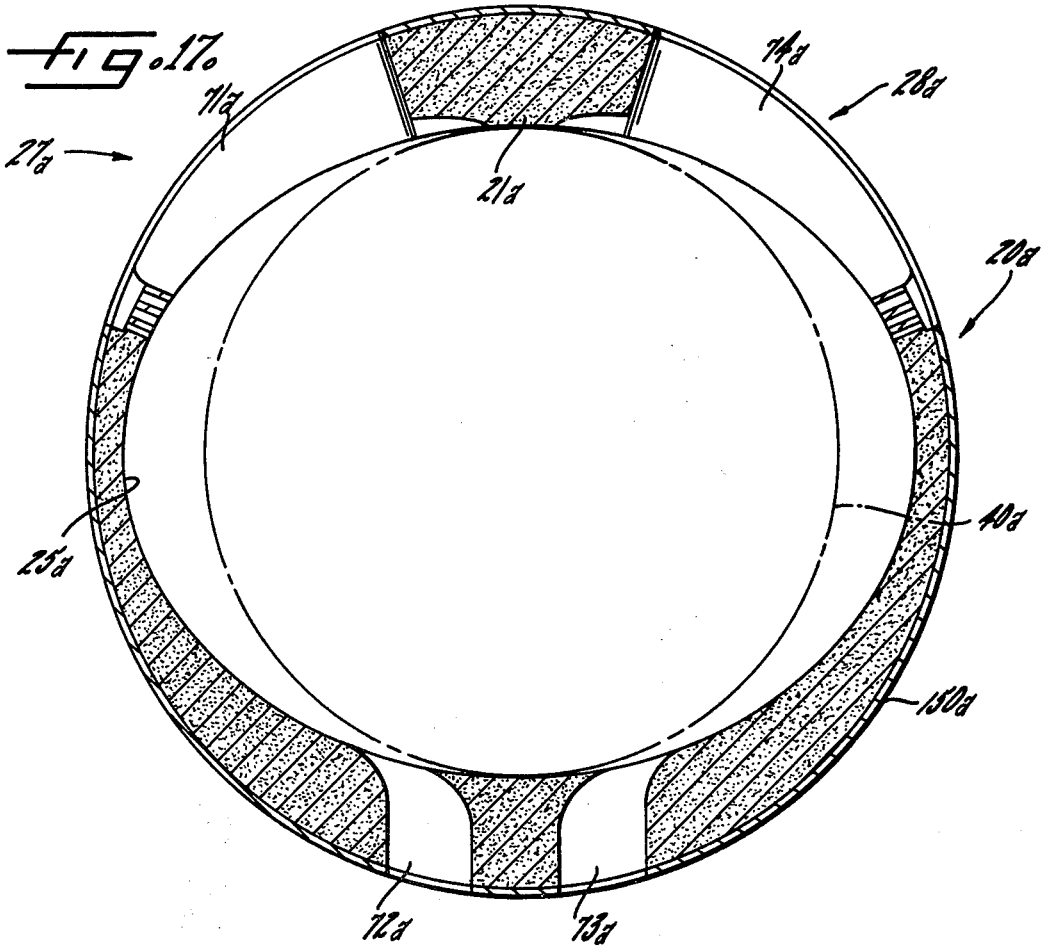

FIG. 17 is a cross-sectional view of a frame of composite construction including a carbon body and cylindrical metal shell or hoop.

Figure 18:
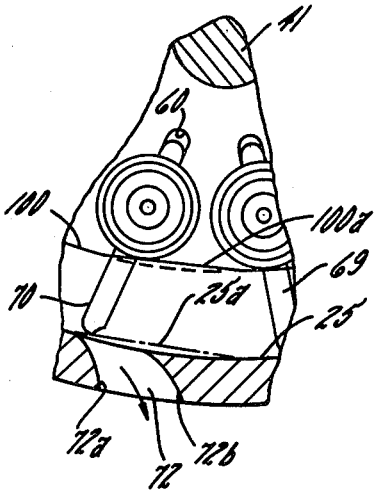

FIG. 18 is a fragment based on FIG. 4 but showing "lift" of a vane at compressor outlet.

Figure 19:
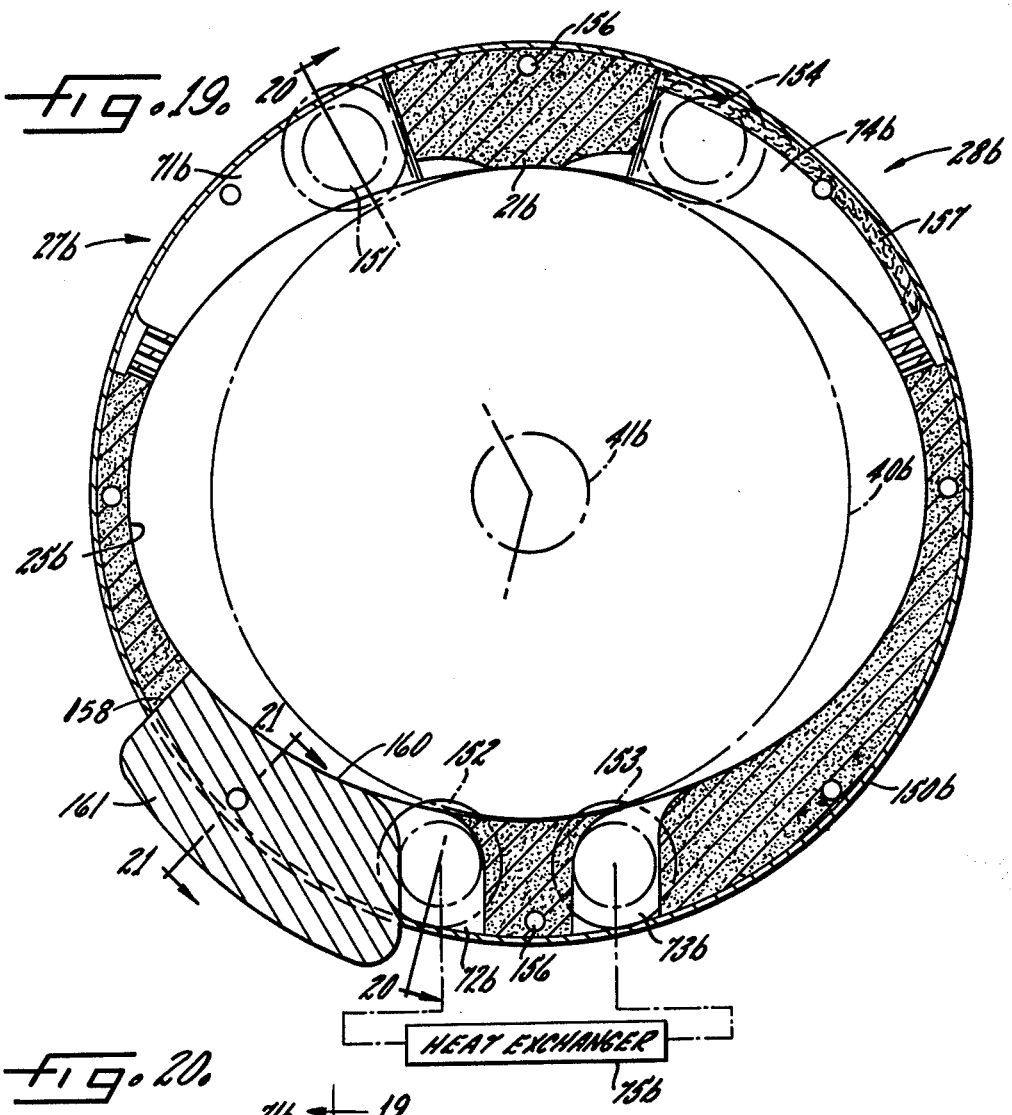
Figure 20:
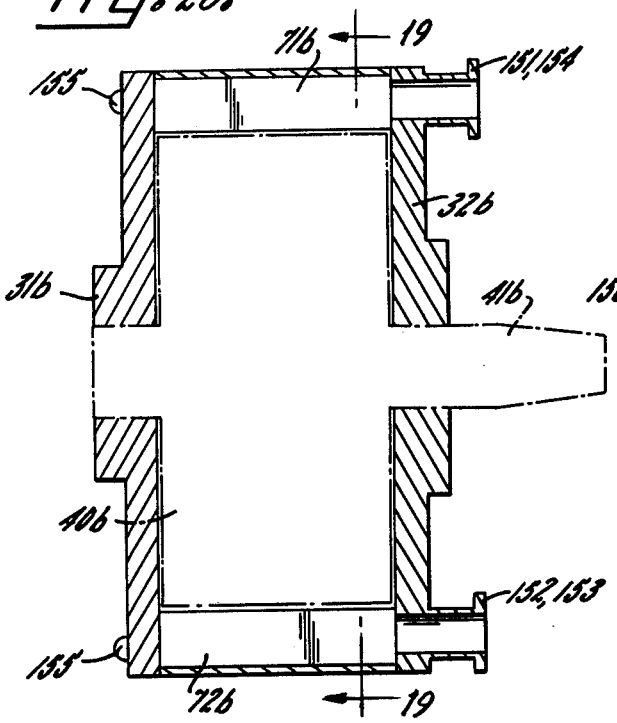

FIG. 19 is a section taken along line 19—19 of FIG. 20 showing a composite frame including segments of carbon and a single finned segment of aluminum.

FIG. 20 is a fragmentary sectional view taken along lines 20—20 in FIG. 19 showing axially extending flow pipes in lieu of manifolds.

Figure 21:
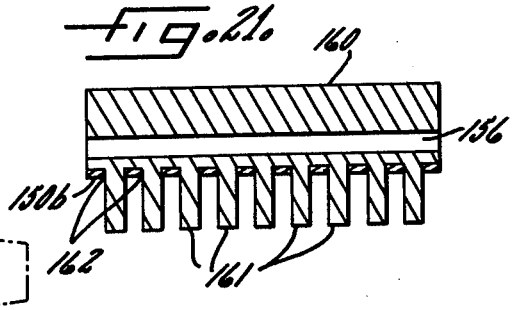

FIG. 21 is a fragmentary section taken along line 21—21 in FIG. 19.

While the invention has been described in connection with certain preferred embodiments, it will be understood that I do not intend it to be limited to the particular embodiments which have been illustrated but intend, on the contrary, to cover the various alternative and equivalent constructions included in the spirit and scope of the appended claims.

Turning now to the drawings, there is disclosed, in FIGS. 1-4, a compressor-expander 20 comprising a frame 21 having an outer wall 22, parallel end faces 23, 24, and an inner wall 25 defining a chamber 26 of elliptical cross-section having a "compressor" side 27 and an "expander" side 28. End bells 31, 32, to which more detailed reference will be made, are secured, for example, by screws 33, to the ends of the chamber. The end bells serve to journal a rotor 40 penetrated by a drive shaft 41 and a stub shaft 42 mounted in alined anti-friction bearings 43, 44, respectively, having associated seals 45, 46. The rotor 40 is of cylindrical shape having a set of radial slots 51-60 in which vanes 61-70 are slidable, the vanes being dimensioned to bridge the space between the end bells with only slight clearance at each end. With the vanes urged outwardly by centrifugal force, adjacent vanes define enclosed compartments in which air is positively compressed, and heated, on the compressor side and positively expanded, and cooled, on the expander side. A compressor inlet port 71 is provided on the compressor side for admitting air which, after compression and heating, is discharged through a compressor side outlet port 72. The air flows directly into a heat exchanger 75, where the heat of compression is removed, then into expander side inlet port 73. Here the air is positively expanded for discharge, in the cold state, at expander side outlet port 74.

For the purpose of guiding the air into, and out of, the ports 71–74, manifolds 81–84 are provided having arcuate bases which are closely fitted to the outer wall 22 of the frame and secured thereto by suitable machine screws. The manifolds 82, 83 may be substantially smaller in size than the manifolds 81, 84 since they handle air which is in a dense, compressed state.

The details of the expander outlet port 74 are shown in FIGS. 5 and 6. The port consists of a plurality of slots 74*a* extending through the wall of the frame having a leading edge or threshold 74*b* formed by a two-dimensional pattern of restricted openings 74*c* of graded size, and to which further reference will be made. It will suffice for the present to say that the restricted openings 74*c* perform a throttling effect for the purpose of noise reduction in the event that the air in the discharging compartment is slightly above or below atmospheric pressure as the leading vane reaches the threshold position. Undercut grooves 74*d* (FIGS. 4 and 6) perform a bypass function, preventing air from being captively compressed as a vane moves beyond the upper end of the port into vertical dead center position.

The inlet port 71 is constructed as a substantial mirror image of the outlet port 74, being formed of a plurality of slots 71*a* and extending to a terminal position 71*c* occupied by a pattern of restricted openings 71*b*, with bypasses 71*d* being provided to prevent a vane passing through the top position from pulling a vacuum..

The shape of the lower ports 72, 73 will be apparent in FIG. 7 where it will be noted that the compressor outlet port 72 has divergently curving walls 72*a*, 72*b* to provide a smooth transition, both as to direction and cross-section, between the tangential flow and the radial flow of the exiting air. Similarly, the expander inlet port 73 has convergently curving walls 73*a*, 73*b* to provide a gradual transition between the radially inward flow, and the tangential flow. As a result of the shape of the openings, turbulence and throttling of the compressed air is minimized, resulting in high pressure recovery and a substantial increase in the efficiency of the device.

In accordance with one of the important aspects of the present invention the central chamber defined by the inner wall 25 of the frame is not in the form of a symmetrical ellipse; instead, the eccentricity of the elliptical chamber on the expander side 28 is made less than the eccentricity on the compressor side 27. More specifically it is found that improved results are achieved when the ratio of the eccentricity on the expander side to the eccentricity of the compressor side falls within the range of 0.700 to 0.950. It has further been found that the eccentricity on the compressor side should be less than 0.72 and should, preferably, lie within the range of 0.55 to 0.68. Still further in accordance with the invention the expander outlet port is so located that when a discharging compartment on the expander side is centered on the major elliptical axis, where the rate of change of volume of the compartment with respect to angle of vane movement is substantially zero, the leading vane of the discharging compartment is at the threshold of the expander side outlet port.

The advantage of maintaining such relationships will be discussed in connection with FIG. 8 which shows a diagrammatic cross section and with FIG. 8*a* which shows the differential eccentricity between the two sides of the device. Prior to discussion of these two figures, however, it will be understood that elliptical eccentricity is defined as:

$$e = \sqrt{1 - (b/a)^2}$$

Where $a$ is the radial length at the transverse or major axis and $b$ is the radial length at the conjugate or minor axis. The separate sides, or halves, of the transverse axis are denoted in FIG. 8, as $a_c$ (for compression) and $a_3$ (for expansion), respectively.

Since the arithmetic difference between the two portions of the transverse axis in the practice of the invention is relatively small, the elliptical profiles on the compression and expansion sides have been superimposed upon one another and indicated, in FIG. 8*a*, at $e_c$ and $e_e$, respectively.

In designing and operating a compressor-expander constructed in accordance with the invention, it will be helpful to consider a compartment of air at four points in the cycle indicated by the cross hatched areas 91–94 (FIG. 8). The area 91 represents the volume of air drawn through the inlet port 71 and trapped in a compartment defined by any two adjacent vanes, for example, a typical leading vane 61 and trailing vane 62 at the moment that the trailing vane 62 closes off the terminus 71*b* of the port 71. A short time later, which in a practical case may be a few thousandths of a second later, the air occupying the volume 91 has been reduced to the volume 92 accompanied by an increase in temperature and pressure. The volume 92 is observed at a time when the leading vane 61 is about to uncover the leading edge of the compressor outlet port 72.

As the rotor continues to rotate, the volume of air indicated at 92 is progressively squeezed through the discharge port 72 and into the heat exchanger 75 where the heat of compression is largely removed. The air in the cooled state, but still under pressure, then passes into the expander inlet port 73 with a volume 93 being trapped between a typical leading vane 61 and trailing vane 62. The expander inlet port 73 is not located in a perfectly symmetrical position with respect to the compressor outlet port 72 but it is, instead, offset "upstream" that is, in the clockwise direction. Because of this, and because of the fact that the eccentricity is less on the expander side, the volume indicated at 93, at the point of cut-off, is less than the volume 92 in such a ratio that the masses of air occupying the compartments 93, 92 are equal, a relationship which is conveniently referred to as "volume compensation."

As the rotor continues to rotate, the air within the compartment is expanded from the volume indicated at 93 to that indicated at 94 resulting in a drop of pressure and a drop in temperature, the air being then discharged in the cold state through the expander outlet port 74.

In carrying out the invention the threshold 74*b* of the expander outlet port is so placed that the discharging compartment 94 is centered on the major axis when the leading vane, here 61, of the discharging compartment is at the threshold 74*b* of the expander side outlet port 74. Stated in other words, where the vanes are at an angular spacing $\alpha$ (36° in the present instance), the threshold of the expander outlet port is located above the transverse axis by an angle of substantially one-half $\alpha$ as shown in FIG. 8. By having a discharging compartment centered on the major axis, the rate of change of volume of the compartment with respect to the angle of vane movement is momentarily zero. Moreover, the eccentricity on the expander side is so chosen that the pressure within the centered, or discharging, compartment is atmospheric under the nominal ambient conditions of pressure, temperature and humidity for which the unit is designed. The meeting of these two conditions results in a substantial improvement in the noise factor, in addition to numerous other advantages which will be discussed in subsequent paragraphs. By tailoring the pressure within the centered, discharging compartment to atmospheric, the air which is initially released from the compartment, as the threshold of discharge, is at the same level as the ambient pressure, so that there is no explosive outward puff of air, nor is there any inward puff, to create a noise vibration. By causing the compartment 94 to be centered at the time of initial discharge, the rate of change of volume with respect to angle is zero so that the location of the threshold is not dimensionally critical.

Further in accordance with the invention a two-dimensional pattern 74c of throttling holes is provided in the region of the threshold so that even where the ambient conditions of temperature, pressure and humidity are subject to wide variation, causing the pressure in the centered space 94 to depart from the atmospheric level, any slight outward or inward puff at the threshold is dissipated by throttling action by reason of the flow resistance of the openings so that it does not result in creation of noise. More specifically in accordance with the invention, the throttling openings are of graded size, increasing in diameter in the direction of vane movement as the threshold is gradually uncovered. Preferably three rows of holes are used of three different diameters as illustrated in FIGS. 4 and 5.

Next consider the geometry in a practical case in which $b$ is approximately 83 millimeters, and $a_c$ is approximately 102 millimeters, and $a_e$ is approximately 99 millimeters, resulting in an eccentricity on the compression side of 0.580 and an eccentricity on the expander side of 0.546, with the ratio of the eccentricities being 0.941.

By employing an eccentricity on the compressor side which is relatively low, say, less than 0.68 and by employing an eccentricity on the expander side which is even lower, in a ratio of 0.60 to 0.95, numerous practical advantages affecting friction, efficiency, and operating life are obtained.

In the first place, the total vane travel is less per revolution; that is to say, vane travel is conserved by use of smaller eccentricity, with reduced travel producing reduced wear. Moreover, by minimizing the average vane extension from the periphery of the roller, one automatically reduces the moment loading on the vane, further reducing wear.

By employing different eccentricity on the two sides, the stopping point at the major axis occurs at different locations on the vane thus more evenly distributing the starting and stopping wear on the vane flank. The total integrated bearing load on the vane rollers is decreased and, since the extension is reduced, the total leakage path around the end of the extended vane is reduced, both effects being directly reflected in an improvement in efficiency. Also, the reduced expander side eccentricity permits the machine to be made somewhat lighter and smaller than would otherwise be possible.

Also, by reducing the relative eccentricity on the expander side, the expander inlet port can be shifted away from the center line, thereby increasing to some degree the net flow area available to the air entering the expander port, while still achieving proper volume compensation.

Further, the fluid flow is enhanced by the smaller expander eccentricity because the exiting gas can begin its exit at a minimum rate of change of volume with respect to rotational angle. This is reflected as a minimum expulsion pressure loss because, at the moment the expulsion of air is initiated, and when the area for flow is very small, the velocity is virtually zero. However, as the angle increases a much larger area is exposed to the exiting vane cavity and this is coordinated with an increased expulsion rate.

A still further benefit of reduced eccentricity is the fact that radial acceleration components are diminished, in fact diminished to such a degree that auxiliary spring bias, urging each vane outwardly, is usually not required.

Finally, by employing a smaller vane excursion, a larger area is available for sealing between the rotor and the end bells, and, as will be discussed, larger guide rollers can be used, with the "fence" of previous end bell constructions being no longer required. While it is true that going to a reduced eccentricity tends to reduce the flow volume per revolution, this can be compensated for by a corresponding increase in shaft speed, with a net improvement in the result.

The main advantage in the use of throttle openings 74c is obtained at the outlet port 74; nevertheless it is one of the features in the present invention that throttling openings are provided at the terminus 71b of the inlet opening 71, a pattern of such openings being indicated at 71c in FIG. 4. It is found that the use of throttling openings at the terminus of the inlet port, in substantially mirror image to the throttling openings at the threshold of the outlet port, results in a further reduction in noise. The reason for this is that as the leading vane 61 (FIG. 8) draws air into the vane compartment 91, friction and inertial effects prevent the demand for air from being instantaneously satisfied, so that a slight vacuum exists in the space 91 as the trailing vane approaches the cut-off point. Because of the pattern of throttling openings 71c, the entering stream of air, rather than being "chopped" with resulting noise, is, instead, "pinched" off more gradually with almost total absence of noise. This condition is optimized by so locating the terminus 71b that the compartment 91, being filled, is centered on the major axis of the ellipse, where the rate of change of volume with angular movement is substantially zero, somewhat analogously to the centering of the compartment 94 on the major axis on the expander side previously discussed.

In accordance with one of the aspects of the present invention, each of the vanes 61–70 is equipped with large diameter guide rollers 96, 97 and the cooperating end bells are of unitary construction, having an elliptical outer wall bounded by a flat end face and having a central bearing sleeve forming an inner wall, the walls being spaced in radial opposition to accommodate the rollers overlappingly with respect to the main shaft bearings as the rollers ride upon the outer wall. The diameter of the rotor exceeds the major dimension of the elliptical outer wall, or cam track, by overlap so that the compartments formed by the vanes are reliably isolated from the roller space.

Thus, referring to FIGS. 3, 9 and 10, which show the end bell 31, it will be seen that the end bell has an elliptical outer wall 100 bounded by a flat end face 101 as well as a central bearing sleeve 102 forming an inner wall 103. The shaft bearing 44 is located inside of the bearing sleeve 102, and the walls 100 and 103 are located in radial opposition to one another so as to provide a roller space 104 which overlaps, and surrounds, the shaft bearing 44 and its associated seal 46. Because of the overlapping of the vane rollers with the associated shaft bearings and seals, a degree of "endwise" compactness is achieved which has been unattainable in prior designs of compressor-expanders and because of the limited eccentricity, the unit is also radially compact.

The inner wall 103 is preferably encircled by a loop of thin gage, highly scuff-resistant plastic material which is sufficiently resilient to serve as a cushion to protect the surface 103 against inward bounce of the rollers 97 which may occur on a transient basis. The loop of plastic material, indicated at 105, is preferably shrink-fitted in position and may be expected to last the life of the machine.

It is one of the features of the end bell construction that the inner wall 100, which guides the vane rollers, is not of constant eccentricity. Instead, the compressor and expander sides of the wall have different eccentricities which are indicated at $100_c$ and $100_e$ in FIGS. 8*a* and 10. While these correspond to the eccentricities $e_c$ and $e_e$ of the inner wall of the chamber they are not in the same ratio; on the contrary, constant radial spacing is established between the roller wall 100 and the elliptical inner surface 25 of the frame so that the tips of the vanes are guided with constant slight spacing with respect to the wall of the chamber at all points during the course of revolution.

To assure accurate centering between the roller wall and the elliptical wall of the chamber, the end face of each end bell has a peripheral step forming a radial seat which registers with the wall of the chamber. Such peripheral step, indicated at 106 (FIGS. 9 and 10), defines a radial seat 107 which has the exact profile of the chamber wall 25. Thus the step 107 has two portions of differing eccentricity indicated at 107*c* and 107*e*. Because of the integral nature of the end bell construction, the surfaces 100*c*, 100*e* may be machined to respectively correspond to surfaces 107*c*, 107*e* while maintaining a high order of accuracy in the differential radius *r*107, all in a single machining set-up and with a high degree of economy. Preferably the end bell has integral cooling ribs 108, which may be formed therein by a casting operation, to increase the amount of the area available for heat transfer and to lighten and strengthen the port.

While discussion has centered upon the left-hand end bell 31, it will be understood that the right hand bell 32 is of identical construction but with the eccentric surfaces thereon formed as a mirror image.

For the purpose of enclosing the end bell 31, the latter is provided with a closure 111 which has clearance with respect to the end of the rotor stub shaft 42. The end bell 32 is enclosed by an annulus 112 which is recessed for a seal 113, preventing the escape of lubricant from the bearing along the surface of the drive shaft 41.

In accordance with one of the more detailed aspects of the present invention the vanes are of improved construction as shown in FIGS. 11–14. A typical vane, indicated at 61, has an outer edge 120 and lateral edges 121, 122. Projecting in alined positions from the vane are hardened stub shafts 123, 124 which mount the rollers 96, 97, respectively. Taking the roller 97 by way of example, the roller includes an outer race 125 (FIG. 13) having a cap-shaped liner 126 which is pressed in place and which surrounds a set of roller bearing elements 127 which ride directly upon the stub shaft 124 and which are sealed, against inward escape of lubricant, by a seal 127*a*. The stub shaft 124 is preferably of hollow construction being fitted with a ferrule 128 which is pressed into place and which serves as a receptacle for a closure button 129 formed of plastic, the latter having a resilient shank which snaps, through a clearance hole formed in the liner 126, into the assembled position shown. The button not only finishes off the outer end of the bearing assembly but serves as an effective seal against escape of lubricant in the axially outward direction. An identical construction is employed for the roller 96 at the other end of the vane and indeed for all of the other rollers included in the assembly. The mount serves to establish an accurate spacing, indicated at *r*107 (see also FIG. 10) between the roller surface and outer edge 120 of the vane. By utilizing hardened stub shafts 123, 124 in direct contact with the roller bearing elements, the elements may be relatively large, contributing to durability, while keeping the vane rollers of compact size.

It is a still further feature of the present invention that the stub shafts 123, 124 are integral with a thin metal insert which is centered within the vane body, either by molding in the body or by cementing in a groove formed in the body. The insert, indicated at 130 in FIG. 14, and shown in section in FIG. 12, is formed of metal and preferably of steel, in rectangular shape and with a pattern of through-openings 131 defining integral truss elements 132 which are subject to beam-type stress in the edgewise direction as the rotor rotates. The pattern of apertures is preferably such as to orient the truss elements at symmetrical angles, thereby providing a high strength-to-weight ratio.

Preferably the insert 130 is cemented in a registering groove 133 which is formed, for example by machining, in the vane body. Where cement is used, the open spaces 131 in the insert define edges accommodating the cement to secure a positive bond. Alternatively, the insert 130 may be molded in place, in which case the spaces 131 are completely filled with the molded material to produce a monolithic construction. In either case the insert not only provides a rigid mount for the stub shafts 123, 124 but also serves to rigidify the vane which surrounds it, in all directions of applied stress.

In the preferred form of the invention the rotor 40 not only overlaps the end faces 101 of the end bells, the region of overlap being indicated at 134 in FIG. 10, but there is provided, in this region of overlap, a set of annular seals to inhibit leakage at the ends of the rotor. A typical sealing ring 135 shown in cross section in FIG. 3*a*, and which may be made of densified cellulose, resides in a groove 136 formed in the end bell and is pressed axially against the rotor 40 by a wave spring 137. In an alternate embodiment shown in FIG. 3*b* the sealing ring 135 presses against an annular bearing ring 138 which is physically secured to the rotor end face.

It is one of the features of the invention that the vanes and rotor are formed of densified amorphous carbon in the interest of reduced friction, freedom from changes in dimension by reason of thermal effects, and economy of material and manufacture. Densified amorphous carbon is available as a material of construction from a number of suppliers, including Pure Carbon Company of St. Mary's, Pa. Generally stated, it is formed by mixing lamp black with pitch as a binder and then subjecting such mixture to combined high heat and high pressure to form a uniform, dense but light weight body having a number of attributes which are especially valuable in the present usage. The material has relatively high strength combined with a low coefficient of friction, good wear characteristics, and an extremely low coefficient of thermal expansion. The material is inherently economical on a bulk basis, is smoothly machinable or moldable to precise dimensional tolerances and is of much lighter weight than steel, the material which has been used heretofore. The material is a good thermal insulator and resists corrosion.

Amorphous carbon is one of the few materials which is mutually self-lubricating when engaged with a like material. However I have found that friction may be even further reduced by using water as a lubricant. The water may be supplied directly to the surfaces through suitable porting or to the entering air stream by injection from a water saturated sleeve 135 in manifold 81. Preferably, however, water is forcibly sprayed into the manifold under pressure from a nozzle 136, as covered in my U.S. application Ser. No. 559,063, the water not only providing lubrication but also increasing the coefficient of performance of the unit as described in such application, any water collecting in the heat exchanger being suitably drained or recycled.

Amorphous carbon is, however, subject to "overfilming" by absorption of grease, resulting in a localized increase in the coefficient of frication, but this can be guarded against by coating the exposed surfaces with a stable inert impregnant to eliminate surface porosity; for example, while it is preferred to make the vanes of carbon, it will be understood that the invention is not limited thereto and that the vanes may be formed of stable, wear-resistant plastic materials.

Where densified amorphous carbon is employed as a rotor material, the rotor may, if desired, be reinforced by a metal spider which serves to strengthen the relatively narrow roots of the individual rotor sectors. In FIGS. 15 and 16, where elements in common with the earlier embodiment are indicated by subscript *a*, two spiders 140, 141 are used, secured at the center to the drive shaft with registering legs which extend radially and which may be recessed "flush" in the ends of the rotor sectors. Longitudinally extending screws 142, fitted into registering openings in the rotor sectors, serve to hold the spider in place in the rotor body, while clamping the body in axial compression.

In carrying out the invention the portion 21 of the frame 20 is preferably formed of either magnesium or carbon. Both of these materials have worthwhile advantages over the use of steel, the material which has been most commonly employed in the past. Both have the advantage of light weight. Magnesium may be either machined to the desired dimension or, in quantity production, formed to dimension by die casting.

Where densified amorphous carbon is employed for the frame, as indicated at 20*a* in FIG. 17, it is preferably encircled, for structural reinforcement, by a band or hoop 150 of conforming circular profile having registering inlet and outlet openings. The hoop is made of a metal, for example steel, in a thickness on the order ot 2 millimeters or more, which is capable of being shrink-fitted upon the body to develop tensile stress, thereby maintaining the frame under radial compression while physically protecting it. If desired the frame may be economically made in the form of segments adhesively bonded to the shell. Elements common to the earlier embodiment are distinguished by addition of subscript *a*.

Because of the guidance provided by the outer elliptical wall 100 of the end bells, the vane rollers can be caused to guide the outer edge 120 of the vanes with precise running clearance with respect to the inner wall 25 of the chamber thereby to minimize "around the vane" leakage. However, the innner surface of the chamber may, if desired, be "auto formed" by coating it, prior to assembly, with a layer of anti-friction material in a layer of interfering thickness and which is capable of being "buttered" down by the wiping action of the vane tips during the initial rotations of the rotor, thereby to provide an extremely minute "grazing" clearance which is maintained during the life of the machine by reason of the dimensional stability of the carbon employed in the vanes and frame of the machine. An example of such an "auto forming" material is an epoxy-graphite mixture made by Superior Graphite Company of Chicago, Ill., applied to the inner surface 25 of the chamber in liquid form by spraying or the like and which subsequently sets or hardens.

In discussing the preferred form of the invention set forth in FIGS. 8 and 8*a*, reference was made to the fact that the compressor side 27 and the expander side 28 were characterized by differential eccentricity, the expander side having less eccentricity in a ratio lying between 0.68 and 0.95. Such differential eccentricity is, in the preferred embodiment brought about by the fact that the radial length $a_e$ of the major axis on the right-hand, or expander, side is less than the radial length $a_c$ of the major axis on the left-hand or compressor side. As a result of this differential eccentricity the volume compartment 94, just prior to discharge, is less than the volume of the compartment 91 of inlet air to the extent that the compartments contain equal masses and so that the air is discharged at substantially atmospheric pressure. It should be understood, however, that it is not necessary to make the elliptical chamber non-symmetrical in order to achieve this equal mass condition. Instead, the chamber may be made symmetrical and the rotor axis, normally occupying the central position A shown in FIG. 8, may be shifted or offset to the right a distance *o* to an axial position A'.

Where this is done the "effective" eccentricity on the two sides of the machine is differentially changed so that the eccentricity on the compressor side approximates:

$$\text{effective } e_c = \sqrt{1 - \left(\frac{b}{a + o}\right)^2}$$

and the eccentricity on the expander side approximates:

$$\text{effective } e_e = \sqrt{1 - \left(\frac{b}{a - o}\right)^2}$$

Consequently, where mention is made herein of the difference in elliptical eccentricity in the two halves of the machine it will be understood that the eccentricity refers to both the "actual" chamber eccentricity using a centered rotor which constitutes the preferred embodiment and the "effective" differential eccentricity using a symmetrical chamber and an offset rotor, with the effect in both cases being substantially the same. Accordingly, it will be seen that the term "ellipse" refers not only to a geometrically precise ellipse but to chambers of generally elliptical shape.

The invention has been described in connection with air as the gaseous medium but it will be understood that the compressor-expander is not limited to use with air and the term therefore includes any gas which is non-condensing at the temperatures and pressures encountered within the unit.

The term "air conditioning" as used herein contemplates use of the device for cooling, as described, or for heating utilizing the heat liberated in the heat exchanger 75.

In accordance with one of the aspects of the present invention means are provided for opening the expander inlet port and compressor outlet port more abruptly thereby to reduce the throttling or "wire-drawing" of the pressurized air. This is accomplished by forming the leading and trailing edges of each vane tip 120 with an abrupt chamfer which extends substantially to the central plane over the length of the vane, the chamfers being preferably of arcuate profile as indicated at 120*a*, 120*b* in FIG. 12*a*. Such chamfers substantially increase the rate of change of air escape cross section as a function of rotor angle. This decreases the arc of rotor angle during which "wire drawing" can occur and improves energy recovery.

In addition, the rate of increase of escape cross section is further improved at the compressor outlet port by forming the elliptical outer wall, or roller track 100 with a "flatted" segment which is substantially coextensive, in the peripheral direction, with the compressor outlet port 72 so that a vane, upon reaching th threshold of the compressor outlet port, is relatively lifted radially inwardly. This is illustrated in FIGS. 10 and 18 in which the flatted segment, indicated at 100*a*, causes the tip of each vane to follow the path 25*a* in which the vane is temporarily out of sealing engagement with the inner wall 25. By the term "flatted segment" as applied to the segment 100*a* is meant that the segment is relatively flat as compared to the elliptical profile. The degree of flatness should be such that the vane is lifted inwardly during the first five degrees or so after engagement with the port threshold at a rate of 0.005 to 0.015 inch per degree of angle. The "flatted segment" rejoins, and smoothly merges with, the elliptical profile at or slightly before the location of the minor axis in order to insure positive sealing at that point, thereby to prevent any carry-over of the compressed air directly to the expander side.

In accordance with one of the aspects of the present invention it is not necessary for the ports to enter and leave the unit radially, but the air may, instead, be ported through one or both of the end bells. Thus, as set forth in FIGS. 19 and 20, a modified structure is shown which is similar to that illustrated in FIG. 17 and in which similar elements are indicated by corresponding reference numerals with addition of subscript *b*. In this embodiment a frame 21*b*, which may be primarily formed of densified amorphous carbon, defines an elliptical chamber 25*b* which is enclosed by end bells 31*b*, 32*b*. Mounted in the chamber is a rotor 40*b* having a shaft 41*b* which is journaled in the end bells. The frame defines compressor inlet and outlet ports 71*b*, 72*b* and expander inlet and outlet ports 73*b*, 74*b*. The frame is encircled and enclosed by a hoop 150*b*.

In carrying out the invention the ports 71–74 are formed to lead the air in the axial direction through corresponding openings formed in the end bells, the openings being fitted with short manifolds, or nipples, 151–154, respectively, as illustrated in cross section in FIG. 20. In the illustrated embodiment all of the ports are shown to communicate with the right-hand end bell 32*b*, but it will be understood to those skilled in the art that a portion of the fittings 151–154 may be in communication with the opposite end bell 31*b*, as may be convenient. Axial porting, as contrasted with the radial porting of the preceding embodiments, has the advantage that a smooth outer profile is maintained and the expense of providing relatively large peripheral manifolds is saved. The assembly illustrated in FIG. 20 is clamped together by axially extending through bolts 155 which penetrate the frame 21*b* through spaced clearance holes 156.

In accordance with one of the more detailed features of the present invention, at least the expander outlet port 74*b* is provided with a layer of insulation to inhibit thermal coupling between the air flowing through the port and the hoop 150 which surrounds the frame, such layer of insulation being indicated at 157. The insulation prevents warming of the air exiting at the expander outlet port, which air is, in the usual case, at a temperature which is substantially below zero, thereby enhancing thermal efficiency. A similar layer of insulation may be provided, if desired, at the compressor inlet port 71*b*.

In accordance with a still further aspect of the present invention, the frame 21*b* is formed of segments of densified carbon or the like arranged end to end at parting lines 158, with the exception that the segment which is adjacent the compressor outlet port, and which is indicated at 160, is formed of metal having good thermal conduction characteristics and formed with integral cooling fins 161 (see also FIG. 21) which extend through registering slots 162 formed in the hoop 150*b*. The fins are thus directly cooled by environmental air. This additional "spot" cooling, at the point of maximum temperature of the air, improves the efficiency of the heat exchange and supplements the action of heat exchanger 75*b*.

It is possible to operate the compressor-expander unit described above either as an "open" system or a "closed" system. The drawings show the unit embodied in an "open" system in which a single heat exchanger is connected between the compressor outlet port and expander inlet port, with the other two ports being opened to atmospheric pressure. One skilled in the art will appreciate that the system may be "closed" by connecting a second heat exchanger between the expander outlet port and compressor inlet port, thereby enclosing, or sealing, the circuit through which the fluid flows, with the advantage that lubricant may be entrained in the circulating fluid and with the further advantage that fluids other than air may be employed. Thus the term "air" as used herein shall be understood generically to include fluids other than air but which perform an analogous function.

I claim as my invention:

1. In an air conditioning system, an air conditioning unit including a frame forming a chamber of elliptical cross section having a compressor side and an expander side and having a smoothly continuous inner wall, end bells secured to the frame for enclosing the chamber, a rotor journaled in the end bells and having vanes cooperating with the wall of the chamber and the end bells to define enclosed compartments, the compressor side and the expander side each having an inlet port and an outlet port formed in the continuous inner wall, means for connecting a heat exchanger between the compressor side outlet port and the expander side inlet port, the heat exchanger being remote from the expander side outlet port, means for conducting air to the compressor side inlet port so that upon driving of the rotor the air (1) is positively compressed and heated in the compressor side, (2) releases heat in the heat exchanger, and (3) is positively expanded and cooled in the expander side for discharge in the cold state from the expander side outlet port, the elliptical eccentricity of the expander side being less than the elliptical eccentricity of the compressor side, the elliptical eccentricity of the chamber on the compressor side being less than 0.72, the compressor side outlet port being formed by outwardly flaring curved surfaces so that the air discharged radially through the compressor side outlet port follows a curved path which varies from substantially tangential to substantially radial in the direction of vane movement, the expander side inlet port being formed of inwardly convergent curved surfaces so that the air entering radially through the expander side inlet port follows a curved path which varies from substantially radial to substantially tangential in the direction of vane movement for minimization of throttling loss at the respective ports.

2. In an air-conditioning system, an air-conditioning unit including and frame having a substantially cylindrical outer surface and forming a chamber of elliptical cross-section having a compressor side and an expander side, end bells secured to the frame for enclosing the chamber, a rotor journaled in the end bells and having vanes cooperating with the wall of the chamber and the end bells to define enclosed compartments, the compressor side and the expander side each having an inlet port and an outlet port, means for connecting a heat exchanger between the compressor side outlet port and the expander side inlet port, the heat exchanger being remote from the expander side outlet port, means for conducting air to the compressor side inlet port so that upon driving of the rotor the air (1) is positively compressed and heated in the compressor side, (2) releases heat in the heat exchanger, and (3) is positively expanded and cooled in the expander side for discharge in the cold state from the expander side outlet port, the elliptical eccentricity of the chamber on the compressor side being less than 0.72 and the elliptical eccentricity of the chamber on the expander side being less than the elliptical eccentricity of the chamber on the compressor side, the frame being made of densified amorphous carbon, and a conforming cylindrical hoop of thin metal having registering inlet and outlet openings and closely fitted upon the outer surface of the frame for maintaining the frame under compression while providing physical protection thereto, the frame being formed by separate segments held together in compression by the hoop and bonded to the latter.

3. In an air conditioning system, an air conditioning unit including a frame forming a chamber of elliptical cross section having a compressor side and an expander side, end bells secured to the frame for enclosing the chamber, a rotor journaled in the end bells and having vanes cooperating with the wall of the chamber and the end bells to define enclosed compartments, the compressor side and the expander side each having an inlet port and an outlet port, means for connecting a heat exchanger between the compressor side outlet port and the expander side inlet port, the heat exchanger being remote from the expander side outlet port, means for conducting air to the compressor side inlet port so that upon driving of the rotor the air (1) is positively compressed and heated in the compressor side, (2) releases heat in the heat exchanger, and (3) is positively expanded and cooled in the expander side for discharge in the cold state from the expander side outlet port, the elliptical eccentricity of the expander side being less than the elliptical eccentricity of the compressor side, the vanes being formed of flat plates of wear resistant non-metallic material, the vanes being slidably mounted in slots extending generally radially of the rotor, each vane having a thin metal insert terminating at its ends in alined stub shafts, vane rollers in the form of anti-friction bearings on said stub shafts, the end bells having elliptical tracks for guiding the rollers for inward and outward movement of the vanes as the rotor rotates.

4. The combination as claimed in claim 3 in which the vanes are formed of densified amorphous carbon, with the thin metal insert being cemented in a groove centrally formed in the vane.

5. The combination as claimed in claim 3 in which the vanes are formed of densified amorphous carbon, with the thin metal insert being molded in place centrally in the vane.

6. The combination as claimed in claim 3 in which the alined stub shafts have hardened surfaces and in which the vane rollers each includes an outer race, with roller bearing elements interposed between the outer race and the hardened surfaces of the cooperating stub shaft and in direct contact with the latter.

7. The combination as claimed in claim 3 in which a cup shaped liner is provided within the outer race and having a clearance hole centrally formed therein, the stub shaft being hollow, and a resilient button having a stem and a head with the stem being captively secured in the stub shaft and the head being seated on the liner surface for sealing the latter.

8. In an air-conditioning system including a frame forming a chamber of elliptical cross-section having a compressor side and an expander side, end bells secured to the frame for enclosing the chamber, a rotor journaled in the end bells and having vanes cooperating with the wall of the chamber and the end bells to define enclosed compartments, the compressor side and the expander side each having an inlet port and an outlet port, means for connecting a heat exchanger between the compressor side outlet port and the expander side inlet port, the heat exchanger being remote from the expander side outlet port, means for conducting air to the compressor side inlet port so that upon driving of the rotor the air (1) is positively compressed and heated in the compressor side, (2) releases heat in the heat exchanger and (3) is positively expanded and cooled in the expander side for discharge in the cold state from the expander outlet port, the compressor inlet port being so located that when a filling compartment on the compressor side is centered on the major axis, where the rate of change of volume of the compartment with respect to the angle of vane movement is substantially zero, the trailing vane of the filling compartment is at the terminus of the compressor side inlet port, the terminal portion of the compressor side inlet port being in the form of restricted openings for throttling any explosive puffing of air inwardly as a result of a slight vacuum in the filling compartment as the filling compartment is closed, the throttling openings being progressively increasing size in the peripheral detection for throttling any explosive puffing of air inwardly or outwardly from the discharging compartment as a result of slight departure, from atmospheric pressure, of the pressure of the initially flowing air in the compartment.

9. The combination as claimed in claim 8 in which the openings are arranged in rows with the openings in respective rows being of progressively increased area in the direction of vane movement.

10. In an air conditioning system, an air conditioning unit including a frame having a substantially cylindrical outer surface and defining a chamber of elliptical cross section having a compressor side and an expander side, end bells secured to the frame for enclosing the chamber, a rotor journaled in the end bells and having vanes cooperating with the wall of the chamber and the end bells to define enclosed compartments, the compressor side and the expander side each having an inlet port and an outlet port, means for connecting a heat exchanger between the compressor side outlet port and the expander side inlet port, the heat exchanger being remote from the expander side outlet port, means for conducting air to the compressor side inlet port so that upon driving of the rotor the air (1) is positively compressed and heated in the compressor side, (2) releases heat in the heat exchanger, and (3) is positively expanded and cooled in the expander side for discharge in the cold state from the expander side outlet port, a conforming cylindrical hoop of relatively thin metal closely fitted upon the outer surface of the frame for maintaining the frame under compression while providing physical protection thereto, the frame being formed of separate segments held together in compression by the hoop, the segment adjacent the compression side outlet port being formed of metal having good thermal conduction characteristics having radially extending fins integral therewith, the hoop having slots formed therein in register with the fins so that the fins extend therethrough for cooling by environmental air.

11. The combination as claimed in claim 10 in which the remaining segments are made of densified amorphous carbon.

* * * * *